US005081496A

United States Patent [19]

Takeda

[11] Patent Number: 5,081,496

[45] Date of Patent: Jan. 14, 1992

[54] IMAGE FORMING APPARATUS HAVING A VENTILATED CONTACT CHARGING UNIT

[75] Inventor: Hiroyuki Takeda, Fukushima, Japan

[73] Assignee: Canon Kabushiki Kaisha, Tokyo, Japan

[21] Appl. No.: 497,889

[22] Filed: Mar. 23, 1990

[30] Foreign Application Priority Data

Mar. 28, 1989 [JP] Japan ..... 1-76251

[51] Int. Cl.[5] ..... G03G 21/00

[52] U.S. Cl. ..... 355/215; 355/219

[58] Field of Search ..... 250/324, 325, 326; 355/200, 210, 215, 219, 260, 221, 274

[56] References Cited

U.S. PATENT DOCUMENTS 4,540,268 9/1985 Toyono et al. ..... 355/210
4,727,453 2/1988 Ewing ..... 250/326 X
4,851,960 7/1989 Nakamura et al. ..... 361/225

FOREIGN PATENT DOCUMENTS 0104972 6/1985 Japan ..... 355/215

*Primary Examiner*—A. T. Grimley
*Assistant Examiner*—Christopher Horgan
*Attorney, Agent, or Firm*—Fitzpatrick, Cella, Harper & Scinto

[57] ABSTRACT

An image forming apparatus includes a charging unit for charging an image carrying member contacting the image carrying member as the charging unit for charging the image carrying member. By generating an airflow along the longer direction of a contact portion between the charging unit and the image carrying member, discharge products generated in the neighborhood of the contact portion are removed. It is thereby possible to prevent image degradation and the like caused by accumulation of the discharge products.

18 Claims, 7 Drawing Sheets

IMAGE FORMING APPARATUS HAVING A VENTILATED CONTACT CHARGING UNIT

BACKGROUND OF THE INVENTION

1. Field of the Invention

This invention relates to an image formining apparatus, such as a copier, a recorder, e.g., a printer, a display or the like, for forming an image by applying a series of image forming processes including a charging (inclusive of charge removing) process for a reusable image carrying member made of a photosensitive material, a dielectric material or the like in an electrophotographic method, a static recording method and the like.

More particularly, this invention relates to an image forming apparatus in which at least an image carrying member and a charging unit for performing charging processing for the surface of the image carrying member among a series of image forming process units are combined in the form of a process cartridge to be detachably mounted on the main body of the image forming apparatus.

Further, this invention relates to an image forming apparatus which uses a charging unit for charging an image carrying member contacting the image carrying member as the charging unit.

2. Description of the Related Art

An image forming apparatus having a detachable process cartridge has mostly been used as the configuration for a convenient and small image forming apparatus suitable for personal use.

For example, in a copier or a printer which utilizes a transfer-type electrophotographic process, a photosensitive drum as an image carrying member, a charging unit for uniformly charging the surface of the drum, a developing unit for developing a latent image formed on the surface of the drum, a cleaning unit for cleaning the surface of the drum after transfer of the image, and the like are combined in the form of a process cartridge which even an inexperienced user can easily detach from the main body of the apparatus and install a replacement unit. Such a detachable process cartridge has, for example, the following advantages. When the detachable process cartridge has reached its durability limit, such as the useful life of the photosensitive drum, consumption of a developer previously housed in the developing unit, and the like, it is replaced with a new cartridge. The image forming apparatus thus becomes maintenance-free with respect to the cartridge. Hence, service capability is improved. Furthermore, by exchanging various kinds of process cartridges having different developing colors, it is possible to change the color of an output image for single color printing, or to form a multicolor synthesized image for multicolor printing.

FIG. 1 shows the schematic configuration of a laser-beam printer as an example of the image forming apparatus having a detachable process cartridge.

In FIG. 1, there is shown an outer case 1 of the apparatus. A photosensitive drum 2, serving as an image carrying member is rotatably driven with a predetermined circumferential speed in the clockwise direction indicated by an arrow. While it is being rotated, the photosensitive drum 2 is subjected to either positive or negative uniform charging by a corona discharge unit 40 as a charging processing means, laser-beam scanning exposure L of the information of an object image by a laser-beam scanner 5, and development (reversal development) by a developing unit 6. Thus, a toner image of the object image is sequentially formed on the surface of the drum 2. A transfer sheet material P is fed one by one from a paper cassette 14 into the apparatus by a paper feeding roller 15. The sheet material P is conveyed to a transfer portion between the drum 2 and a transfer unit 7 by a pair of registration rollers 16 in synchronization with the rotation of the photosensitive drum 2. The toner image on the drum 2 is then transferred to the surface of the conveyed sheet material P.

The sheet material P on which the toner image has been transferred while passing through the transfer portion is then separated from the surface of the drum 2, and is introduced into a fixing unit 11 by a conveying unit 10. The image is fixed in the fixing unit 11, and the sheet material having the fixed image is output onto a paper discharging tray 13 outside the apparatus as a printed matter by a discharging roller 12.

After the transfer of the toner image, the surface of the drum 2 is subjected to removal of any attached contaminants, such as residual toner and the like, by a cleaning unit 8, erasure of electric residual memory by preexposure processing, i.e., light illumination upon the entire surface by an erasure lamp 9, and is then ready for another image formation. A mirror 5*a* reflects the laser beam output from the laser-beam scanner 5 in the direction of the surface of the photosensitive drum 2.

In the apparatus of the present example, the four process units, i.e., the photosensitive drum 2, the corona discharge unit 40, the developing unit 6 and the cleaning unit 8, are configured as a process cartridge 20. The cartridge 20 is detachably mounted on a predetermined position within the main body of the apparatus by releasing the apparatus by means of an appropriate opening/closing method for the apparatus, such as a method of releasing the front door and upper body of the apparatus or the like. When the cartridge 20 is properly mounted within the main body of the apparatus, the units within the cartridge 20 and the units within the main body of the apparatus are mechanically and electrically coupled with one another. The units 2, 6, 8 and 40 are incorporated within an outer housing, i.e., a cartridge frame 21 of the cartridge combined in a predetermined relationship. An opening 22 for exposure by an incident laser beam and an opening 23 for preexposure by the incident erasure light beam are provided at respective predetermined positions on the upper surface of the cartridge housing 21.

As a unit for charging the photosensitive drum 2 for readiness as an image carrying member, the corona discharge unit 40 having a corona discharging wire is generally used. However, such a corona discharge unit has at least the following four problems:

1) It is necessary to apply a high voltage of 4–8 kV (kilovolts) to the wire in order to obtain the surface potential of 500–700 V (volts) on the photosensitive body. The distance between the wire and the electrodes must be large in order to prevent leakage to the electrodes and to the main body, and the like. Consequently, the discharging unit itself becomes large in size. Furthermore, it is necessary to use a covered cable to provide a high level of insulation.

2) The majority of the discharge current from the wire flows to a shielding electrode. The corona current flowing to the side of the photosensitive body as a member to be charged represents only a few percent of the total discharge current.

3) Discharge products, such as ozone and the like, are generated by the corona discharge. Accordingly, oxidation of components in the apparatus and image blurring, shading due to degradation of the surface of the photosensitive body by ozone are easily produced. This phenomenon is particularly pronounced in highly humid environment. by ozone are easily produced. In addition, it is necessary to provide a filter for absorbing and decomposing ozone, and a fan as an airflow generation means for the filter to prevent ozone from coming in contact with humans.

4) In order to increase discharge efficiency, a discharge wire having a relatively large diameter is used. In general, a wire having a diameter of 60–100 μm is preferred. A high electric field formed on the surface of the wire attracts fine dust within the apparatus. Therefore, the surface of the wire becomes contaminated. The contamination of the wire tends to produce an uneven discharge, which results in unevenness in the formed image. Hence, it is necessary to frequently clean the wire and the inside of the discharge unit.

Particularly troublesome is an image forming apparatus in which a process cartridge 20 including at least an image carrying member and a corona discharge unit 40 as a charging means for charging the image carrying member incorporated within a closed cartridge housing 21. Hence, airflow within the cartridge housing 21 is obstructed, and discharge products, such as ozone and the like, tend to be present in high density between the inner and outer peripheral portions of the discharge unit 40 and within the entire cartridge, in general. Accordingly, the above-described problem 3) becomes particularly serious.

Heretofore, it has been intended to prevent the problems of image blurring, shading and the like caused by discharge products by the following approach. By making the opening 22 for exposure in the cartridge housing 21 an air inlet and the opening 23 for preexposure an air outlet, a vacuum system is provided so that positive airflow A in the circumferential direction of the drum is drawn in from outside the housing 21 through the opening 22 then passes through the inside of the housing 21 between a facing gap portion between the photosensitive drum 2 and the discharge unit 40 through the opening 23 to the outside of the housing. Thus, the air containing discharge products, such as ozone and the like, which are produced particularly within and around the discharge unit 40 and the air within the housing 21 are positively exhausted to the outside. U.S. Pat. No. 4,540,268 issued to Toyono, et al. on Sept. 10, 1985, for a Process Kit and Image Forming Apparatus Using Such Kit discloses a kit 17 having ventilation slits positioned on either side of a discharger.

On the other hand, there has recently been studied the utilization of a contact charging means in place of a corona discharge unit but such has various problems as a charging means.

More specifically, the surface of a photosensitive body is charged to a predetermined potential by contacting the surface of the photosensitive body as a body to be charged with a conductive member, i.e., a conductive member for maintaining potential, such as a brush made of conductive fibers, a conductive roller or the like, to which a D.C. voltage of about 1 kV is applied.

FIG. 2 shows a cartridge in which a charging roller 4 as a contact charging member is disposed contacting the surface of the photosensitive drum 2 in place of the corona discharge unit 40 as a charging means in the process cartridge 20 of FIG. 1 apparatus.

The contact charging means has the advantages that it can function with a voltage which is lower than the voltage needed for the corona discharge unit. Consequently, the amount of discharge products, such as ozone and the like, is small. Nevertheless, in the case of using the process cartridge, although the amount of discharge products is small, discharge products the amount of which finally causes image blurring, shading and the like are eventually accumulated. If the air within the cartridge housing is not ventilated, the discharge products accumulate around the charging member and in the space within the housing while charging operations are repeatedly performed.

However, ventilation means in the case of using the corona discharge unit as the charging means as described above is not practically effective as a ventilation means within the cartridge. That is, in the case of using a contact charging means, since the charging roller 4 as the charging means is disposed so as to contact the surface of the photosensitive drum 2 in the direction of the drum's generatrix. Therefore, a gap portion for ventilation does not exist between the photosensitive drum 2 and the charging roller 4 as in the case of using the corona discharge unit 40. (Actually, as will be discussed later a "microscopic" gap does not exist therebetween.) Accordingly, even if a ventilation means for introducing external air from the opening 22 and exhausting the air from the opening 23 is provided within the cartridge housing 21, sufficient airflow is not produced at portions "a" and "b" (in FIG. 2). The portions are near the charging roller situated at the upstream and downstream sides relative to the rotation of the drum 2 from the portion where the charging roller contacts the photosensitive drum 2. Hence, discharge products tend to be accumulated and remain at these portions with the passage of time, causing image blurring, shading, and the like.

SUMMARY OF THE INVENTION

It is an object of the present invention to provide an image forming apparatus in which image deterioration, such as image blurring, shading, and the like, caused by discharge products is not caused.

It is another object of the present invention to provide an image forming apparatus which can effectively remove discharge products produced when a charging means for charging an image carrying member contacting the image carrying member is used.

It is still another object of the present invention to provide an image forming apparatus and its process cartridge capable of performing proper ventilation within the process cartridge having a contact-type charging means as described above.

In accordance with one aspect of the present invention, an image forming apparatus comprises an image carrying member, a charging means for charging the image carrying member contacting the image carrying member, and means for generating an airflow along the longitudinal direction of a contact portion established between the image carrying member and the charging means.

In accordance with another aspect of the present invention, an image forming apparatus comprises a process cartridge to be detachably mounted on the image forming apparatus comprising an image carrying member, a process means for acting on the image carrying member, and a housing for supporting the image carrying member and the process means. The housing for the process cartridge includes ventilation openings. The process means includes at least charging means for charging the image carrying member and is in contact with the image carrying member. Means for generating airflow are provided such that an airflow is generated along the longitudinal direction of a contact portion established between the image carrying member and the charging means. The means for generating the airflow cooperates with the ventilation openings in the housing of the process cartridge.

In accordance with yet another aspect of the invention, a process cartridge is detachably mounted on an image forming apparatus and comprises an image carrying member, and a process means for acting on the image carrying member. The process means includes at least charging means for charging the image carrying member contacting the image carrying member. A housing for supporting the image carrying member and the process means includes an air passage along the longitudinal direction of a contact portion established between the image carrying member and the charging means.

These and other objects, aspects, and features of the present invention will become more apparent from the following detailed description made in reference to the accompanying drawings.

DETAILED DESCRIPTION OF A PREFERRED EMBODIMENT

Figure 1:
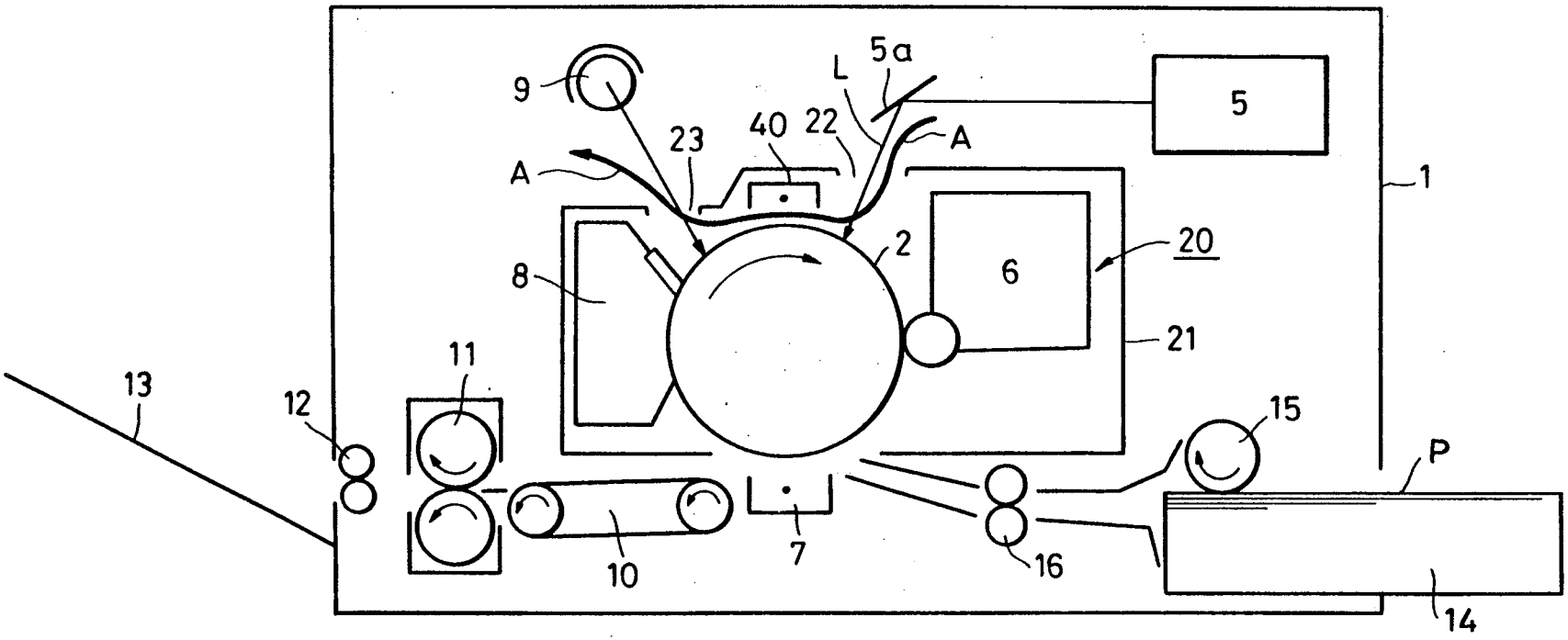
FIG. 1 is a schematic, sectional view of an image forming apparatus on which a process cartridge is detachably mounted.
Figure 2:
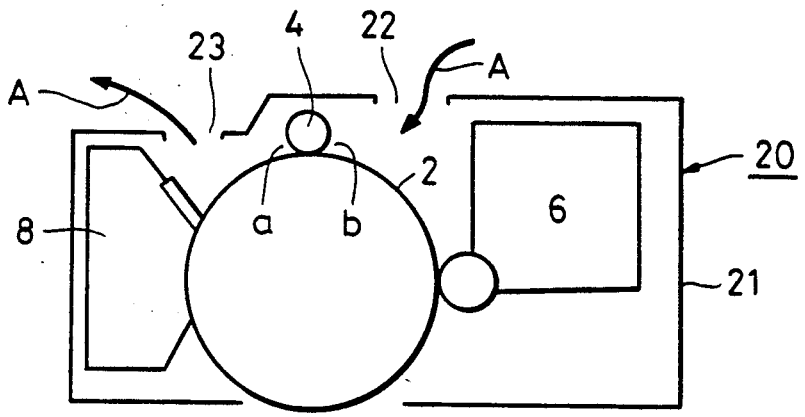
FIG. 2 is a schematic, sectional view of a process cartridge in which a contact charging unit (a charging roller) is used as a charging means.
Figure 3:
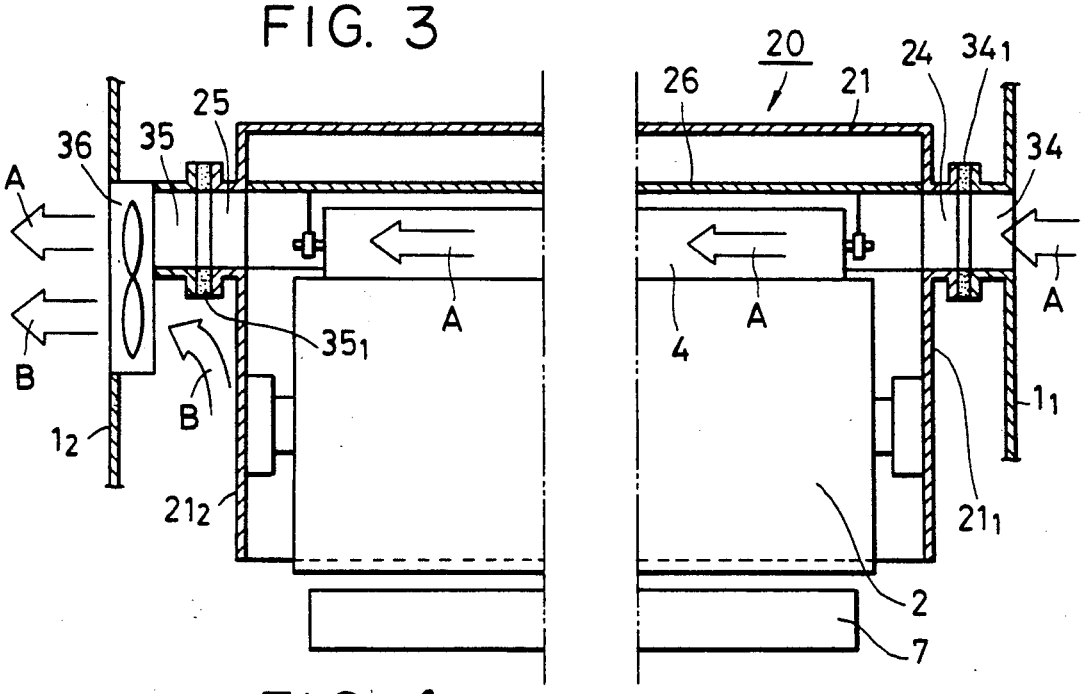
FIG. 3 is a vertical sectional side view of a principal part of an apparatus according to an embodiment of the present invention.
Figure 4:
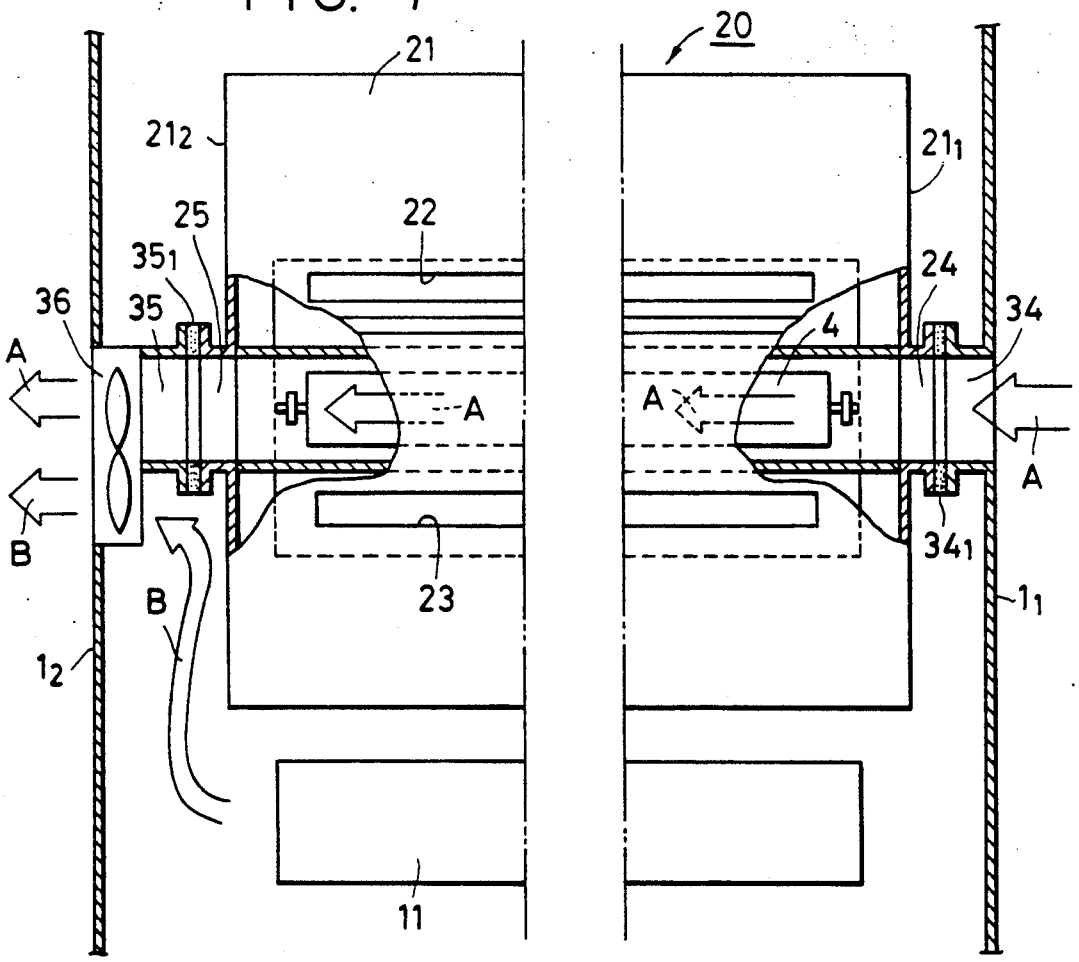
FIG. 4 is a partially cutaway plan view of the principal part.
Figure 5:
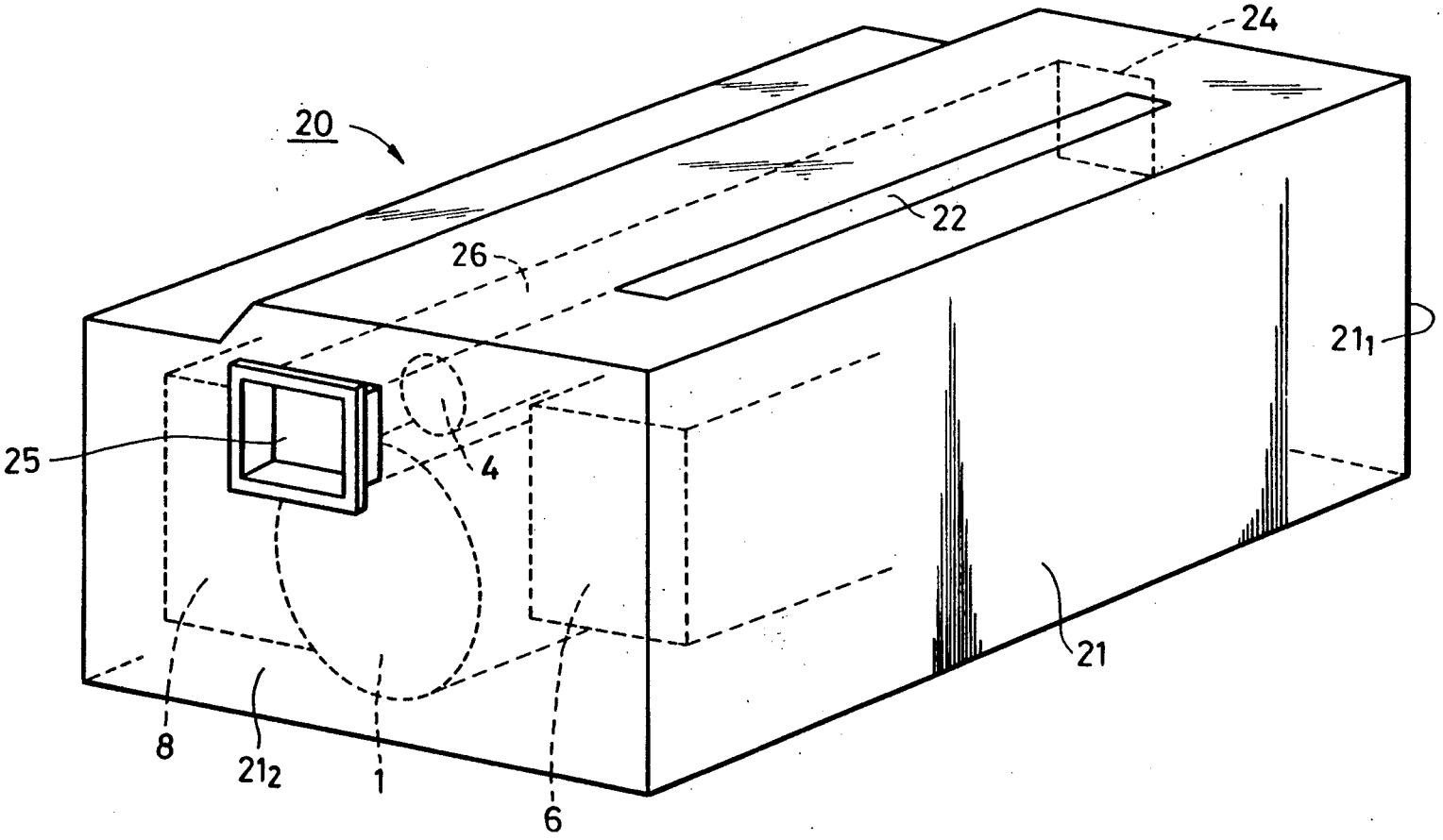
FIG. 5 is a perspective view of the appearance of a process cartridge.

FIGS. 3 and 4 show a principal part of an image forming apparatus according to an embodiment of the present invention. FIG. 5 shows a process cartridge which is detachably mounted on the image forming apparatus. Components and portions which are common to those in the apparatus shown in FIG. 1 and in the cartridge shown in FIG. 2 described above are indicated by like reference characters, and a further explanation thereof will be omitted.

An opening 24 for drawing in air and an opening 25 for exhausting air are provided in a right-end face plate $\mathbf{21}_1$ and a left-end face plate $\mathbf{21}_2$ of a cartridge housing 21, respectively. The two openings 24 and 25 are provided at positions in the face plates corresponding to right-end and left-end positions of the charging roller 4 as the contact charging member within the cartridge 20, respectively.

A wind tunnel member, i.e., a duct member, 26 having the cross section of the shape of a downward turned "U" is provided within the cartridge surrounding three sides, i.e., the upper, left and right sides, of the charging roller 4. Its right-end and left-end sides communicate with the opening 24 for drawing in air and the opening 25 for exhausting air in the cartridge housing 21, respectively.

An opening 34 for ventilation is provided in a right chasis plate $\mathbf{1}_1$ of the main body of the image forming apparatus. An exhaust fan 36 is provided in a left chasis plate $\mathbf{1}_2$ of the main body of the apparatus. An opening 35 for drawing in air is provided so as to communicate with the exhaust fan 36.

When the process cartridge 20 is properly mounted within the main body of the image forming apparatus with predetermined procedures, the opening 24 for drawing in air and the opening 24 for exhausting air in the cartridge 20 communicate with the opening 34 for ventilation and the opening 35 for drawing in air in the main body of the apparatus, respectively. In this case, sealing members $\mathbf{34}_1$ and $\mathbf{35}_1$ made of moltplane rubber, or the like, may be adhered to the areas around the openings 34 and 35 in the main body of the apparatus, or the the openings 24 and 25 in the cartridge 20, respectively. Thus, the openings 24 and 25 are coupled in an air-tight communicating state with the openings 34 and 35, respectively.

Furthermore, it is desirable that the openings 24 and 25 in the cartridge 20 are configured so that a shutter member (not illustrated) is provided in order to maintain the openings 24 and 25 in a closed state when the cartridge 20 is taken out of the main body of the apparatus for the purpose of storage, or the like. Thus, external light and foreign matter, such as dust, and the like, are prevented from entering the openings 24 and 25. The shutter member is opened when the cartridge 20 is mounted within the main body of the apparatus.

In the apparatus of the present embodiment, the exhaust fan 36 is configured so that an area equal to about half of its inlet surface is used as a dedicated inlet surface for the opening 35 for drawing in air, and the remaining inlet surface is used as an exhaust surface for allowing the heat produced from a fixing unit 11 to be vented out of the apparatus.

According to the operation of the exhaust fan 36, airflow A is produced through the route (1) an inlet (not illustrated) for external air provided at an appropriate portion of the main body of the apparatus, (2) the inside of the main body of the apparatus, (3) the opening 34 for ventilation in the main body of the apparatus, (4) the opening 24 for drawing in air in the cartridge, (5) the inside of the wind tunnel member 26 surrounding the charging roller 4, (6) the opening 25 for exhausting air in the cartridge 20, (7) the exhaust fan 36, and (8) an exhaust port (not illustrated) provided at an appropriate portion of the main body of the apparatus. Airflow B is also produced through the route the inlet for external air in the main body of the apparatus, the inside of the main body of the apparatus, the exhaust fan 36, and the exhaust port.

The wind tunnel member 26 may take the form of a rectilinear duct surrounding the charging roller 4 from the side of the opening 24 for drawing in air at one end of the roller 4 to the side of the opening 25 for exhausting air at another end. That is, it extends from one end to the other end of the charging roller 4. The airflow passing through the wind tunnel member 26 within the cartridge 20 becomes an airflow along the longitudinal direction, i.e., the direction of the generatrix, of the photosensitive drum 2 along the contact portion between the charging roller 4 and the photosensitive drum 2.

Accordingly, discharge products, such as ozone and the like, produced in a small amount around the charging roller 4 by the execution of charging operation are smoothly and efficiently exhausted outside the cartridge 20 on the abovedescribed airflow A along the longitudinal direction of the charging roller 4. That is, the fact that the charging roller 4 contacts the photosensitive drum 2 and there is no gap suitable for ventilation between the charging roller 4 and the photosensitive drum 2 has no effect on ventilation in this arrangement. Consequently, the exhaust of discharge products produced around the charging roller 4 outside the cartridge is effectively performed. It is to be noted that the wind tunnel member 26 surrounding the charging roller 4 may be omitted. However, by providing a member such as the member 26, it is possible to reduce the drawing-in resistance of the airflow along the longitudinal direction of the roller around the charging roller 4 to increase the airflow rate, and thus to promptly exhaust and remove mainly the discharge products produced around the charging roller 4. Furthermore, it is possible to obtain a sufficient airflow rate even with only one fan 36 at the exhaust side. Hence, the present configuration is a configuration which is most effective and suitable for a small image forming apparatus, such as a laser-beam printer or the like. It is also possible to provide a configuration in which a fan is also provided at the inlet side in order to obtain a larger airflow rate.

Although an axial-flow-type fan, a cross-flow-type fan, or any other appropriate fan may be used, it is desirable to use a fan which has large static pressure and airflow rate, that is, a fan which can maintain a sufficient airflow even if the drawing-in resistance is large. Furthermore, it is desirable to provide a means, such as an ozone filter or the like, at an appropriate position in the air passage.

Figure 6:
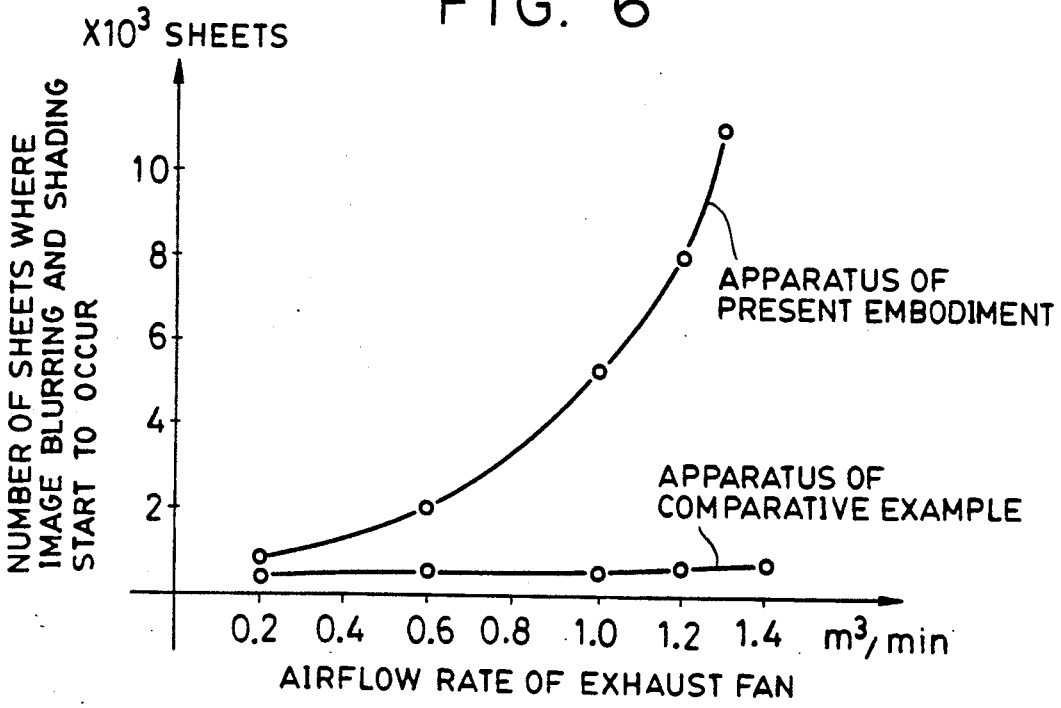
FIG. 6 is a graph comparing the results of measurements of the function to prevent image blurring, shading, and the like for the apparatus of the present embodiment and the apparatus of a comparative example.

The function of preventing image deterioration was measured and compared for the apparatus of the embodiment of the present invention and an apparatus (the apparatus of a comparative example) in which the air within the cartridge is ventilated by introducing air from the opening 22 in the cartridge housing 21 into the cartridge 20 and exhausting the air from the opening 23 as shown in FIG. 2. The conditions for the measurements were as follows:

Photosensitive body: OPC photosensitive drum
Charging roller: D.C. voltage of −1230 V applied
Surface potential of the drum: −700 V
Room temperature, humidity: 30° C., 80%, FIG. 6 is a graph showing the results of the measurements. In the apparatus of the comparative example, image blurring and shading were produced beginning at about 1,000 printed sheets irrespective of the airflow rate of the exhaust fan. It can be understood that, in the apparatus according to the present invention, the onset of image deterioration is dramatically delayed as the airflow rate of the exhaust fan is increased.

Figure 7:
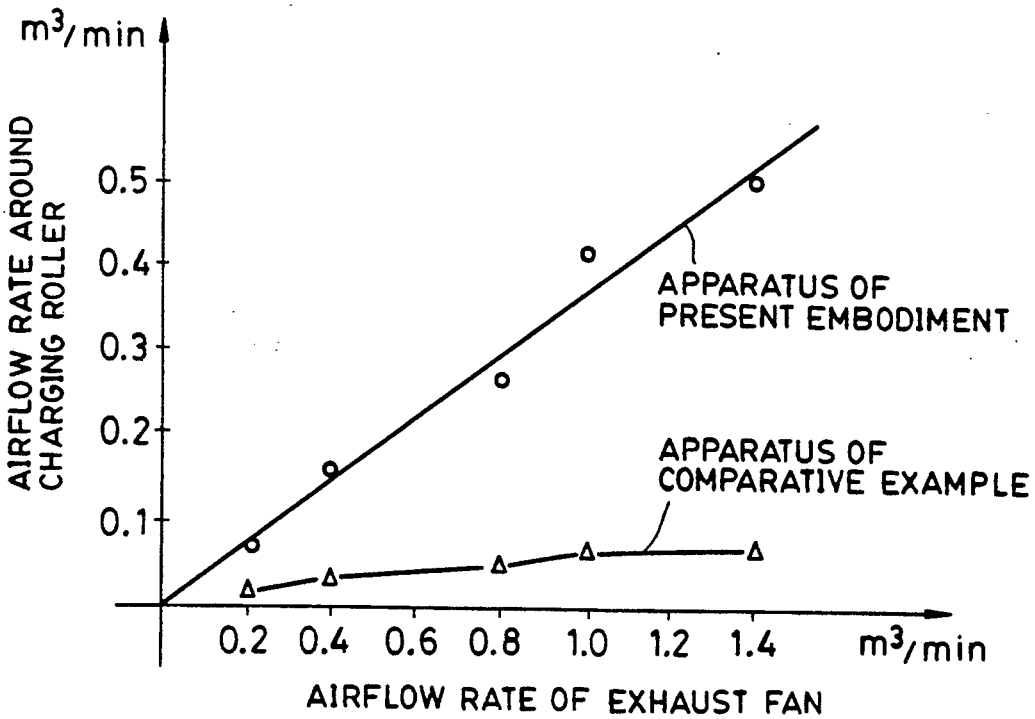
FIG. 7 is a graph showing the relationship between the airflow rate of an exhaust fan and the airflow rate around a charging roller for the above-described two apparatuses.

These results can be explained from the relationship between the airflow rate of the exhaust fan and the airflow rate around the charging roller 4 shown in FIG. 7. That is, in the case of the apparatus of the present embodiment, the airflow rate around the charging roller also increases as the airflow rate of the exhaust fan is increased. Hence, an airflow which is effective for removing discharge products is produced around the charging roller. In contrast, in the case of the apparatus of the comparative example, the airflow around the charging roller always remains at a low level even if the airflow rate of the exhaust fan is increased. Hence, an airflow which is large enough for removing discharge products is not produced, and discharge products therefore tend to accumulate.

Although, in the embodiment described above, the openings are formed in the cartridge frames at two end sides of the charging roller to perform ventilation, the present invention is not limited to this configuration. Other arrangements are effective provided that an air passage is formed along the longitudinal direction of the contact portion between the charging roller and the photosensitive drum within the cartridge to allow ventilation. The situation is identical even when the cartridge is not used. It suffices that the air passage as described above is formed within the main body of the image forming apparatus to perform ventilation.

The mechanism of contact charging used in the present invention will now be explained.

Figure 8:
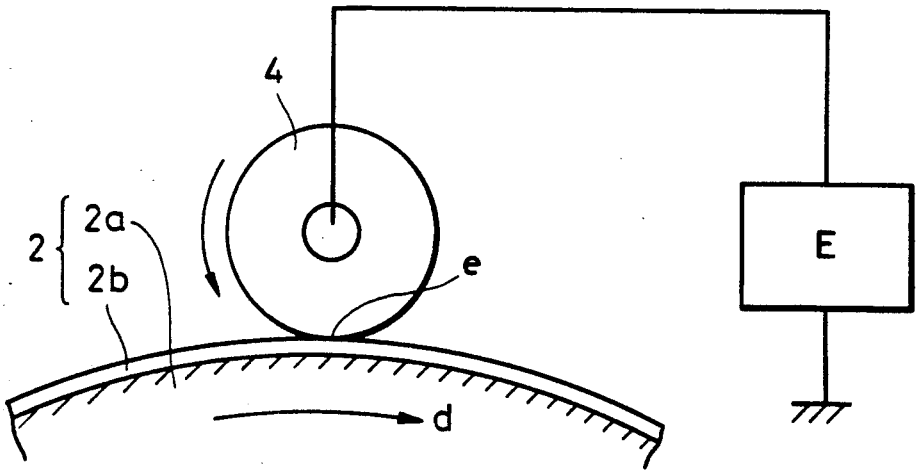
FIG. 8 is a diagram for explaining the mechanism of contact charging.

In FIG. 8, there is shown a part of an electrophotographic photosensitive drum 2 as a body to be charged which is provided by forming a photosensitive layer **2*b* (a layer of a photoconductive material, such as an organic semiconductor, amorphous silicon, selenium or the like) on the outer circumferential surface of the body 2*a* of the drum. The drum 2** is driven in the direction of arrow d with a predetermined speed.

A conductive charging roller 4 as a contact charging member contacts the surface of the photosensitive drum 2 with predetermined pressure, and is passively rotated in the direction of the arrow in accordance with the rotation of the photosensitive drum 2. A power supply E applies voltage to the charging roller 4. There is also shown a contact portion "e" between the charging roller 4 and the photosensitive drum 2.

Figure 9A:
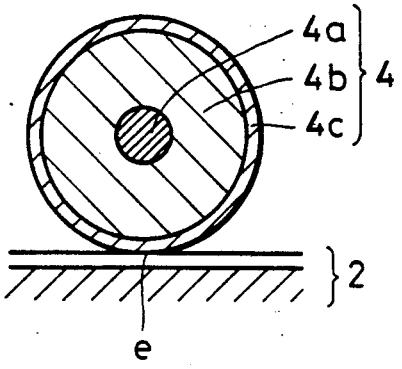
FIGS. 9A and 9B are transverse sectional views of two examples of contact charging members.
Figure 9B:
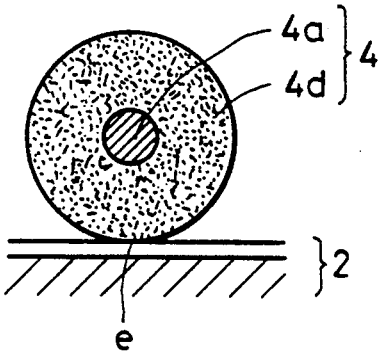

As the charging roller 4, it is possible to use a roller having the configuration of two-layer coatings. A metal mandrel **4*a* is coated with a layer 4*b* of elastic rubber, such as EPDM, NBR or the like. This is further coated with a layer 4*c* of carbon-dispersed urethane rubber (resistance $\sim 10^5\Omega$) on the circumferential surface of the layer 4*b*, as shown in FIG. 9A. One could also use a roller made of a metal mandrel 4*a* coated with a layer 4*b*** of carbon-dispersed foam urethane rubber, as shown in FIG. 9B, and the like.

The contact charging roller 4 is not limited to a rotatable roller. A nonrotating roller, a pad member or a blade member may also be used.

As the photosensitive layer 2b of the photosensitive drum 2, an organic photoconductor layer (an OPC layer) having negative polarity 19 μm thick made by laminating a carrier generation layer (a CGL layer) of a diazo pigment anda carrier transport layer (a CTL layer) made by a mixture of hydrazone and a resin was used. The photosensitive drum 2 was rotatably driven, the charging roller 4 was brought in contact with the surface of the drum 2, and contact charging of the photosensitive drum 2 was performed in the dark applying a D.C. voltage $V_{DC}$ to the charging roller 4. The relationship between the surface potential V of the charged OPC photosensitive drum 2 after passing through the charging roller 4 and the D.C. voltage $V_{DC}$ applied to the charging roller 4 was measured.

Figure 10:
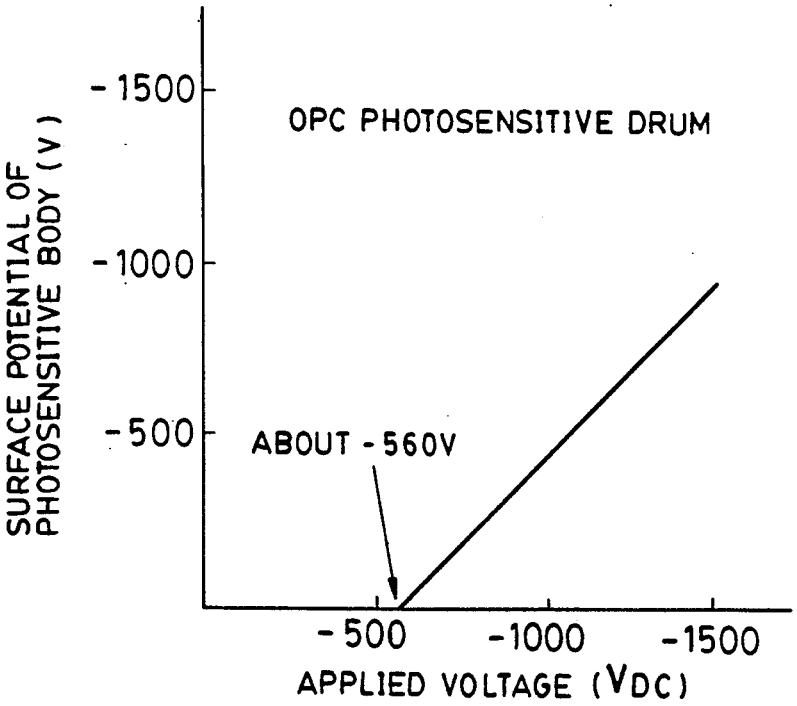
FIG. 10 is a graph showing the relationship between the applied voltage and the surface potential of a photosensitive body.

The graph of FIG. 10 shows the result of the measurement. Charging has a threshold value for the applied D.C. voltage $V_{DC}$. Charging starts from about −560 V, and a linear relationship having a slope of 1 in the graph is obtained between the surface voltage V and the applied voltage of the voltage to start charging or above. An almost identical effect was obtained in varied environmental characteristics (for example, in environment of high temperature and high humidity, and in environment of low temperature and low humidity).

That is, there is the relationship $$Vc = Va - VTH.$$

where Va is the D.C. voltage applied to the charging roller 4, Vc is the charging potential obtained on the surface of the photosensitive drum, and $V_{TH}$ is the voltage required to start charging.

The above-described expression can be derived using Paschen's law.

Figure 11:
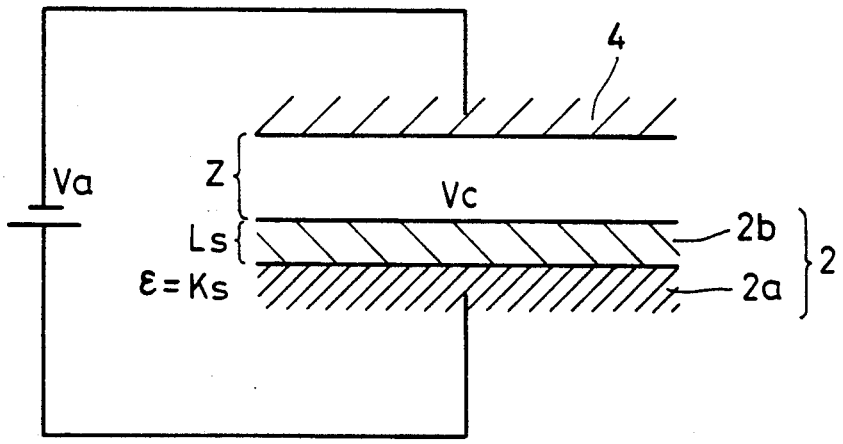
FIG. 11 is a diagram for explaining a microscopic gap between a contact charging member and a photosensitive body, and elements relating to contact charging.

As shown in FIG. 11, the voltage Vg applied between a microscopic gap Z between the charging roller 4 and the OPC photosensitive drum 2b (for example, a gap between the surface of the charging roller and the surface of the photosensitive drum gradually separating from each other) is expressed by the following expression (1):

$$Vg = (Va - Vc)Z/(Ls/Ks + Z) \quad (1),$$

where

Va: applied voltage

Vc: the surface potential of the photosensitive layer

Z: the thickness of the gap

Ls: the thickness of the photosensitive layer

Ks: the relative dielectric constant of the photosensitive layer.

On the other hand, relative to the discharge phenomenon at the gap Z, the discharge breakdown voltage Vb may be approximated by the following primary expression (2) for Z=8 μm or more by Paschen's law:

$$Vb = 312 + 6.2Z \quad (2).$$

Figure 12:
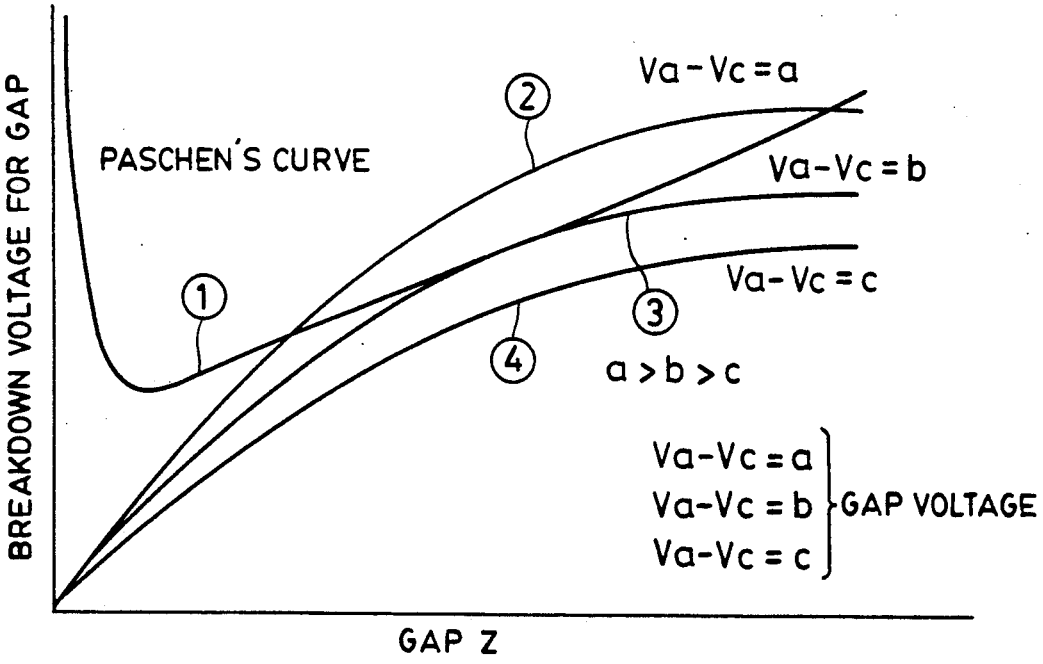
FIG. 12 is a graph showing the correlation between the gap and breakdown voltage for the gap.

The expressions (1) and (2) are represented by graphs as shown in FIG. 12. In FIG. 12, the abscissa represents the gap distance Z, and the ordinate represents the breakdown voltage for the gap. The downwardly convex curve (1) represents Paschen's curve, and the upwardly convex curves (2), (3) and (4) represent the characteristics of the gap voltage Vg for various values of the parameter (Va−Vc).

A discharge is produced when the Paschen's curve (1) crosses the curves (2)−(4). At the point where discharge starts, the discriminant in a quadratic of Z in which Vg=Vb becomes 0. That is, $$(Va - Vc - 312 - 6.2 \times Ls/Ks)^2 = (4 \times 6.2 \times 312 \times Ls/Ks) \quad (3)$$

$$Vc = Va - (\sqrt{7737.6 \times Ls/Ks} + 312 + 6.2 \times Ls/Ks)$$

$$(Vc = Va - V_{TH}).$$

If the value 3 for the relative dielectric constant of the OPC photosensitive layer 2b and the value 19 μm for the thickness of the CTL used in the above-described experiment are put into the right-hand part of the expression (3), we obtain $$Vc = Va - 573.$$

This value nearly coincides with the experimental expression obtained before.

Paschen's law relates to the discharge phenomenon in a gap. The generation of ozone, though minute in amount ($10^{-2} - 10^{-3}$ compared with the case of corona discharge), was also present immediately near the charging unit in the charging process using the above-described charging roller 4. Hence, it is considered that charging has some kind of relation with the discharge phenomenon.

Although the generation of discharge products, such as ozone and the like, is small in quantity, the density of the discharge products contained in the air near the contact charging member 4, such as a charging roller or the like, is increased by being accumulated while charging operations are repeated if the airflow is inferior. Finally, it reaches an amount which is enough for producing phonomena such as image blurring, shading, and the like.

The mechanism of the generation of image blurring and shading caused by discharge products is considered as follows. The discharge products ($O_3$, $NO_x$ and the like) react with talc (a magnesium compound), and the like, as the components of paper powder generated from a recording material, such as transfer paper or the like, to produce conductive materials, which adhere on the surface of the photosensitive drum 2. In addition, the discharge products react with the surface layer of the drum to make the surface of the drum locally or totally conductive, and hence the charge retention property of the drum is descreased.

Accordingly, even in the case of an image forming apparatus using a contact charging means, ventilation for at least in the neighborhood of the charging member 4 must be performed, although the generation of discharge products is small in quantity. This is all the more important particularly in the case of an apparatus using a process cartridge having a closed structure.

Although a charging means to which only D.C. voltage is applied has been shown in the above-described embodiment, a charging means to which a superposed voltage consisting of D.C. voltage and A.C. voltage is applied may of course be used in the present invention. Such an arrangement is described in U.S. Pat. No.

4,851,960 issued to Nakamura, et al. on July 25, 1989 for a Charging Device.

Furthermore, although a process cartridge in which a charging roller, a developing unit and a cleaning unit are supported as one body has been shown in the above-described embodiment, it suffices that the process cartridge in the present invention includes at least an image carrying member and a contact charging means for charging the image carrying member.

As explained above, according to the present invention, discharge products generated in a small amount around a contact charging member by the execution of charging are always smoothly and efficiently exhausted outside an image forming apparatus on the airflow along the longitudinal direction of the contact portion between the contact charging member and an image carrying member. The fact that the contact charging member contacts the image carrying member and there is no gap for ventilation between the two members does not become a factor to obstruct ventilation, and the exhaust and ventilation of the generated discharge products outside the image forming apparatus is effectively executed. Accordingly, it is possible to effectively prevent the phenomena that the discharge products remain in the neighborhood of the contact charging member contacting the image carrying member. The density of the discharge products increases by being accumulated over time, and image degradation and the like are produced.

Furthermore, by taking measures so that discharge products do not accumulate, it is also possible to prevent deterioration in properties and shortening of life of the image carrying member, the contact charging member and the like.

The present invention is particularly effective for an image forming apparatus having a detachable process cartridge in which such a contact charging member is used.

While the present invention has been described with respect to what is presently considered to be a preferred embodiment, it is to be understood that the invention is not to be limited to the same. To the contrary, the present invention includes all modifications and arrangements within the scope of the appended claims. The scope of the following claims is to be accorded the broadest interpretation so as to encompass all such modifications and equivalent structures and functions.

What is claimed is:

1. An image forming apparatus comprising:

a movable image carrying member;

charging means for charging said movable image carrying member by contacting said movable image carrying member; and means for generating an airflow along a direction substantially perpendicular to the moving direction of said movable image carrying member at a contact portion established between said movable image carrying member and said charging means.

2. An image forming apparatus according to claim 1, wherein said charging means includes a rotating member in rotating contact with said movable image carrying member, wherein a predetermined voltage is applied to said rotating member.

3. An image forming apparatus according to claim 1, wherein said means for generating an airflow includes a fan, which is disposed at an end portion relative to a direction substantially perpendicular to the moving direction of said movable image carrying member of said charging means.

4. An image forming apparatus according to claim 1, wherein said movable image carrying member is a movable photosensitive member.

5. An image forming apparatus comprising:

a process cartridge to be detachably mounted on said image forming apparatus comprising a movable image carrying member, a process means for acting on said movable image carrying member, and a housing for supporting said movable image carrying member and said process means, said housing of said process cartridge including ventilation openings, wherein said process means in said process cartridge includes at least one charging means for charging said movable image carrying member and is in contact with said movable image carrying member; and means for generating an airflow along a direction substantially perpendicular to the moving direction of said movable image carrying member at a contact portion established between said movable image carrying member and said charging means within the process cartridge, wherein said means for generating an airflow causes air to be drawn in and discharged through said openings.

6. An image forming apparatus according to claim 5, wherein said movable image carrying member is a movable photosensitive member.

7. An image forming apparatus according to claim 5, wherein said ventilation openings are provided at two end portions of said charging means relative to a direction substantially perpendicular to the moving direction of said movable image carrying member of said charging means.

8. An image forming apparatus according to claim 7, wherein said means for generating an airflow includes a fan, which is disposed at a main body of said image forming apparatus facing at least a ventilation opening at one end portion of said charging means.

9. An image forming apparatus according to claim 5, wherein said charging means includes a rotating member in rotating contact with said movable image carrying member, and predetermined voltage is applied to said rotating member.

10. An image forming apparatus according to claim 5, wherein said process cartridge includes a tunnel member surrounding said charging means along a direction substantially perpendicular to the moving direction of said movable image carrying member of the charging means.

11. An image forming apparatus according to claim 5, wherein said means for generating an airflow includes a ventilation passage communicating with said ventilation openings in said housing of said process cartridge within a main body of the image forming apparatus.

12. A process cartridge to be detachably mounted on an image forming apparatus comprising:

a movable image carrying member;

a process means for acting on said movable image carrying member, said process means including at least one charging means for charging said image carrying member contacting the movable image carrying member; and a housing for supporting said movable image carrying member and said process means, said housing including an air passage portion along a direction substantially perpendicular to the moving direction of said movable image carrying member at a contact portion established between said movable image carrying member and said charging means.

13. A process cartridge according to claim 12, wherein said housing includes openings at end portions of said charging means relative to a direction substantially perpendicular to the moving direction of said movable image carrying member of the charging means.

14. A process cartridge according to claim 12, wherein said charging means includes a rotating member in rotating contact with said image carrying member, and predetermined voltage is applied to said rotating member.

15. A process cartridge according to claim 12, wherein said movable image carrying member is a movable photosensitive member.

16. An image forming apparatus according to claim 1, wherein said means for generating an airflow generates an airflow along a direction substantially perpendicular to the moving direction of said movable image carrying member from one end to the other end of said movable image carrying member in the area adjacent to a contact portion established between said movable image carrying member and said charging means.

17. A process cartridge according to claim 12, wherein said air passage portion is along a direction substantially perpendicular to the moving direction of said movable image carrying member from one end to the other end of said movable image carrying member in the area adjacent to a contact portion established between said movable image carrying member and said charging means.

18. An image forming apparatus according to claim 5, wherein said means for generating an airflow generates an airflow along a direction substantially perpendicular to the moving direction of said movable image carrying member from one end to the other end of said movable image carrying member in the area adjacent to a contact portion established between said movable image carrying member and said charging means.

* * * * *

UNITED STATES PATENT AND TRADEMARK OFFICE

CERTIFICATE OF CORRECTION

PATENT NO. : 5,081,496

DATED : January 14, 1992

INVENTOR(S) : Takeda

It is certified that error appears in the above-identified patent and that said Letters Patent is hereby corrected as shown below:

COLUMN 3:

Line 7, "by ozone are easily produced." should be deleted.

COLUMN 8:

Line 6, "80%," should read --80%.--.

COLUMN 9:

Line 10, "anda" should read --and a--.

Signed and Sealed this

Seventeenth Day of August, 1993

Bruce Lehman

*Attest:*

BRUCE LEHMAN

*Attesting Officer*

*Commissioner of Patents and Trademarks*